United States Patent [19]

Crowell

[11] 3,946,264

[45] Mar. 23, 1976

[54] INFRA-RED RESPONSIVE CAMERA TUBE

[75] Inventor: Merton Howard Crowell, Cumberland, R.I.

[73] Assignee: North American Philips Corporation, New York, N.Y.

[22] Filed: Apr. 18, 1975

[21] Appl. No.: 569,269

[52] U.S. Cl. ..... 313/388; 250/332; 313/386

[51] Int. Cl.[2] H01J 29/89; H01J 39/49; H01J 31/26

[58] Field of Search ..... 313/101, 388, 386, 384; 250/213 R, 332

[56] References Cited

UNITED STATES PATENTS 3,812,396 5/1974 Crowell..... 250/332 X 3,909,654 9/1975 Conklin et al. ..... 313/388

*Primary Examiner*—Robert Segal

*Attorney, Agent, or Firm*—Frank R. Trifari; Carl P. Steinhauser

[57] ABSTRACT

A camera tube employs a target comprising a layer of optically transparent infra-red radiation responsive material and a layer of photoconductive material which is scanned, in conventional manner, by an electron beam. This tube combines the principles of a infra-red image sensor with the more conventional principles of a vidicon target.

3 Claims, 3 Drawing Figures

INFRA-RED RESPONSIVE CAMERA TUBE

This invention relates to an improved camera tube employing a target comprising a layer of optically transparent infra-red radiation responsive material and a layer of photoconductive material which is scanned by an electron beam.

In U.S. Pat. No. 3,812,396, issued May 21, 1974, an infra-red image sensing tube is described which employs an image sensing target which can be a single crystal of triglycine sulfate (TGS). The TGS target, as there disclosed, generates a response to the incident radiation by first absorbing it and then using the resultant heat to produce a voltage profile on the electron gun side of the target which is a replication of the incident radiation.

While this produces the best performance for an uncooled detector in the far infra-red region (i.e., 8–14$\mu$m), in the visible wave-length region its performance is much below more conventional image tubes. This is true for at least two reasons: (1) the effective guantum efficiency of a pyroelectric detector is always much less than photon counting or photoconductive devices; and (2) the resulting heat pattern produced by the incident radiation can and does spread side-wise and thus reduces the resolution capabilities of the device.

It is accordingly an object of the invention to provide an improved image sensing device employing a thermally responsive target.

In accordance with the invention, a target is employed in an image sensing device which is not only responsive to infra-red radiation but also to visible radiation thereby combining the principles of the aforesaid infra-red radiation responsive target with the more conventional principles of a vidicon target. The tube according to the invention employs a target comprising a layer of optically-transparent infra-red responsive material and a layer of photoconductive material which is responsive to visible radiation, and so positioned that the photoconductive layer can be scanned by an electron beam. In addition suitable potentials are applied to the photoconductive layer and the layer of infra-red responsive material so that the tube responsivity resulting from the visible radiation can have the same or the opposite sign as the responsivity resulting from the infra-red radiation.

Preferably, voltages are applied to the photoconductive layer and the layer of infra-red radiation sensitive material for which the internal dipole domains within the latter material will align themselves so that their positive ends will be pointing toward the source of infra-red radiation, i.e. the image. Thus, when incident radiation heats the target, the dipoles will decrease in magnitude and cause the resulting voltage profile on the electron gun side of the target to be positive. Also, any radiation absorbed by the photoconductive layer will reduce the resistance of the layer and cause the electron gun side of the target to become more positive.

By proper selection of the photoconductive material, the electronic method of generating the pedestal current is not required.

The invention will be described in greater detail with reference to the drawing in which.

Figure 1:
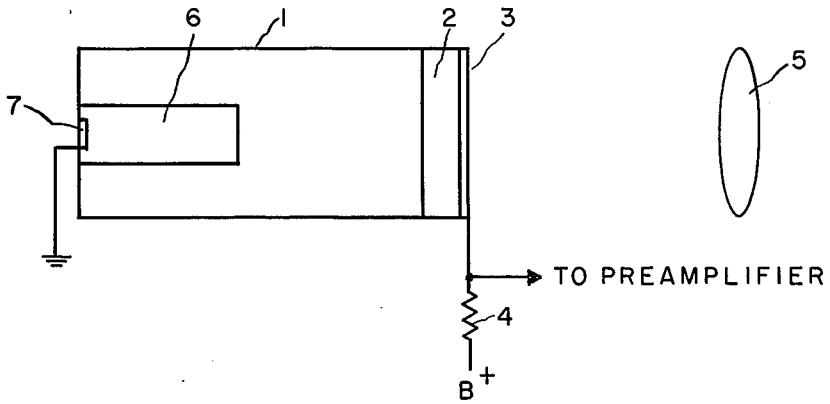
Fig. 1 PRIOR ART
FIG. 1 shows a known thermal imaging tube.

The known tube, as described in the aforesaid patent, simply includes, with unessential details omitted, an envelope 1 having a target 2 consisting of a single crystal of triglycerine sulfate (TGS) mounted at one end adjacent a window 3 which is infra-red radiation transmissive. The inner surface of the window 3, in contact with the target 2, is provided with a very thin, infra-red transmissive, electrically conductive coating, for example tin oxide or antimony, which is connected to a potential source through a resistor 4. When an image is focussed on the target by a lens 5, a thermal image will form in the target resulting in a voltage profile on the opposite side of the target. If that side is scanned by an electron beam produced by an electron gun 6 having the usual cathode 7, a signal voltage will be produced across resistor 5 which can be coupled to a conventional pre-amplifier for further processing.

The device described in connection with FIG. 1 represents the current state of the art. It also has serious short-comings, namely as pointed out, above its effective quantum efficiency is much less than that of a photoconductive device, although it sees a thermal image rather than a visible image which may be advantageous otherwise. Moreover, the resulting heat pattern produced by the incident radiation can, and does spread laterally and thus reduces the resolution capabilities of the device.

Figure 2:
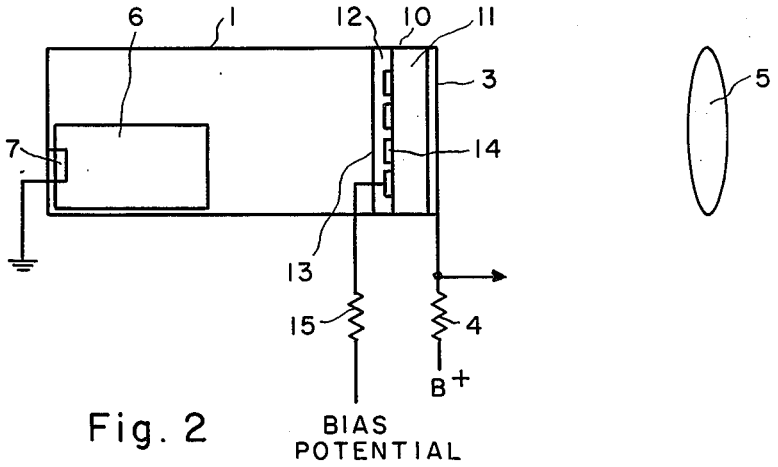
FIG. 2 shows a thermal imaging tube according to the invention.

The device according to the invention which is shown in FIG. 2 avoids these disadvantages while retaining those of the known device, as well as providing additional advantages.

Basically, the device shown in FIG. 2 employs a new target which combines the advantages of a thermally imaging target with those of a photoconductive target so that the tube can produce a signal corresponding to both a thermal image and a visible image.

As in the prior art device of FIG. 1, the target generally designated 10 is positioned at one end of an evacuated envelope 1 having a window 3 transmissive for infra-red as well as visible radiation. The image is formed on the target by a lens 5. Similarly, the inner surface of the window is covered with a very thin infra-red and light transmissive electrically conductive material, e.g. tin oxide which is connected to a source of positive potential through a resistor 4. An electron gun 6 having the usual cathode 7 for generating an electron beam is provided at the other end of the envelope.

The target 10 comprises a layer 11 of infra-red responsive material such as TGS which is also transparent to visible light. On the other side of the TGS layer 11, a layer 12 of photoconductive material, for example $Sb_2S_3$ or PbO is provided. This layer which has a surface 13 which may be scanned by the electron beam responds to incident photons which produces a voltage profile corresponding to the intensities in the visible image.

Figure 3:
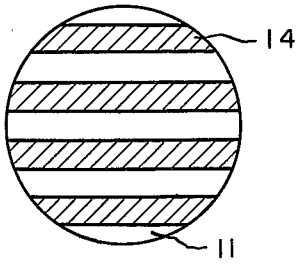
FIG. 3 shows a portion of the target of the tube in greater detail.

Provided between the photoconductive layer 12 and the infra-red sensitive layer 11 are conductive strips 14 which are connected a separate source of potential through a decoupling resistor 15. These strips may also be seen in FIG. 3 where they are shown covering portions of the infra-red radiation responsive layer 11 (after the photoconductive layer 12 is removed).

Providing that the photoconductive layer is thin (~ 1 micron) this target provides responsivity to the infra-red portion of the incident radiation during scanning by the electron beam as described in connection with FIG. 1. However, the visible portion of the incident radiation would be transmitted through the TGS and be absorbed in the photoconductive layer.

By applying suitable potentials to the conductive strips 14 and to the TGS portion of the target, different responsivities can be obtained.

For example, to obtain responsivities of the same sign +10 volts may be applied to the conductive strips through resistor 15 and −10 volts to the TGS through resistor 4.

With these voltages, the internal dipole domains within the TGS target will align themselves so that their positive ends will be pointing toward the infra-red radiation source, i.e. the lens. Thus, when incident radiation heats the target, the dipoles will decrease in magnitude and cause the resulting profile on the electron gun side of the target to be positive. Also, any radiation absorbed by the photoconductive layer will reduce the resistance of the layer and cause the electron gun side to become more positive.

By applying positive potentials of +10 volts and +20 volts, respectively, to the conductive strips and the TGS layer, the same photoconductive response as described would be produced but the opposite responsivity would be produced from the TGS.

Finally, unlike as described in the above patent, by proper selection of the photoconductive material, the electronic method for generating the pedestal current is not required.

What is claimed is:

1. A camera tube comprising an evacuated envelope, an electron gun within said envelope for producing an electron beam, and an image sensing target disposed within said envelope to be scanned by said electron beam, said target comprising a transparent, electrically conductive layer, an optically transparent layer of infra-red radiation responsive material on said layer and disposed to receive a visible and infra-red image and transmit the visible image while converting the infra-red image into a voltage profile, said target further comprising a layer of photoconductive material disposed to receive the transmitted visible image and convert the same into a potential image which is scanned by the electron beam, a plurality of conductive strips between said optically transparent layer and said photoconductive layer, means to apply a potential to the photoconductive layer and the infra-red radiation responsive layer at which the electron beam lands on the photoconductive layer reducing the layer at the point of landing to cathode potential whereby a signal is produced corresponding to the light intensity and intensity of infra-red radiation at said landing point.

2. A camera tube as claimed in claim 1 wherein the signals produced, respectively, by the photoconductive layer and the infra-red responsive layer have the same algebraic sign.

3. A camera tube as claimed in claim 1 wherein potentials are applied, respectively, to the photoconductive layer and the infra-red radiation responsive layer for which internal dipole domains will align themselves with their positive ends pointing toward the infra-red radiation.

* * * * *